United States Patent [19]

Royal

[11] 4,023,471

[45] May 17, 1977

[54] APPARATUS FOR ASSEMBLING A CARTON

[75] Inventor: Thomas B. Royal, Homestead, Fla.

[73] Assignee: International Paper Company, New York, N.Y.

[22] Filed: Apr. 24, 1975

[21] Appl. No.: 571,075

[52] U.S. Cl. ..... 93/39 R; 93/51 R; 93/55

[51] Int. Cl.[2] ..... B31B 17/26

[58] Field of Search ..... 93/55, 55.1 R, 39 R, 93/39.1 R, 36 R, 36 MM, 51 R, 51 M

[56] References Cited

UNITED STATES PATENTS

| | | | |
|---|---|---|---|
| 1,859,640 | 5/1932 | Walter | 93/39 R X |
| 3,650,183 | 3/1972 | Striplin | 93/36 MM X |
| 3,659,505 | 5/1972 | Wasyluka et al. | 93/36 MM X |
| 3,673,928 | 7/1972 | Striplin | 93/39 R X |

FOREIGN PATENTS OR APPLICATIONS

| | | | |
|---|---|---|---|
| 1,018,311 | 1/1953 | France | 93/39 R |

*Primary Examiner*—James F. Coan
*Attorney, Agent, or Firm*—Alfred L. Michaelsen

[57] ABSTRACT

A method and apparatus for assembling a carton from a body forming blank and a pair of end forming blanks wherein the end forming blanks each include a pair of side flaps and a bottom flap.

3 Claims, 10 Drawing Figures

FIG. 7
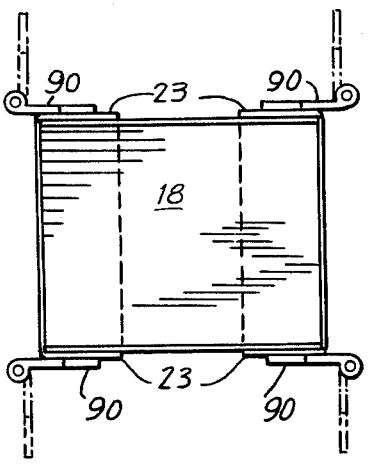
FIG. 8
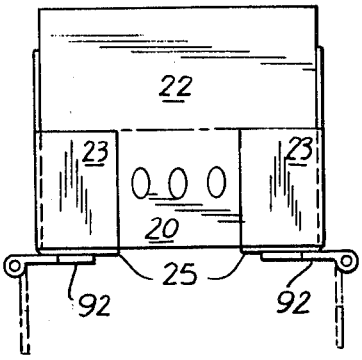
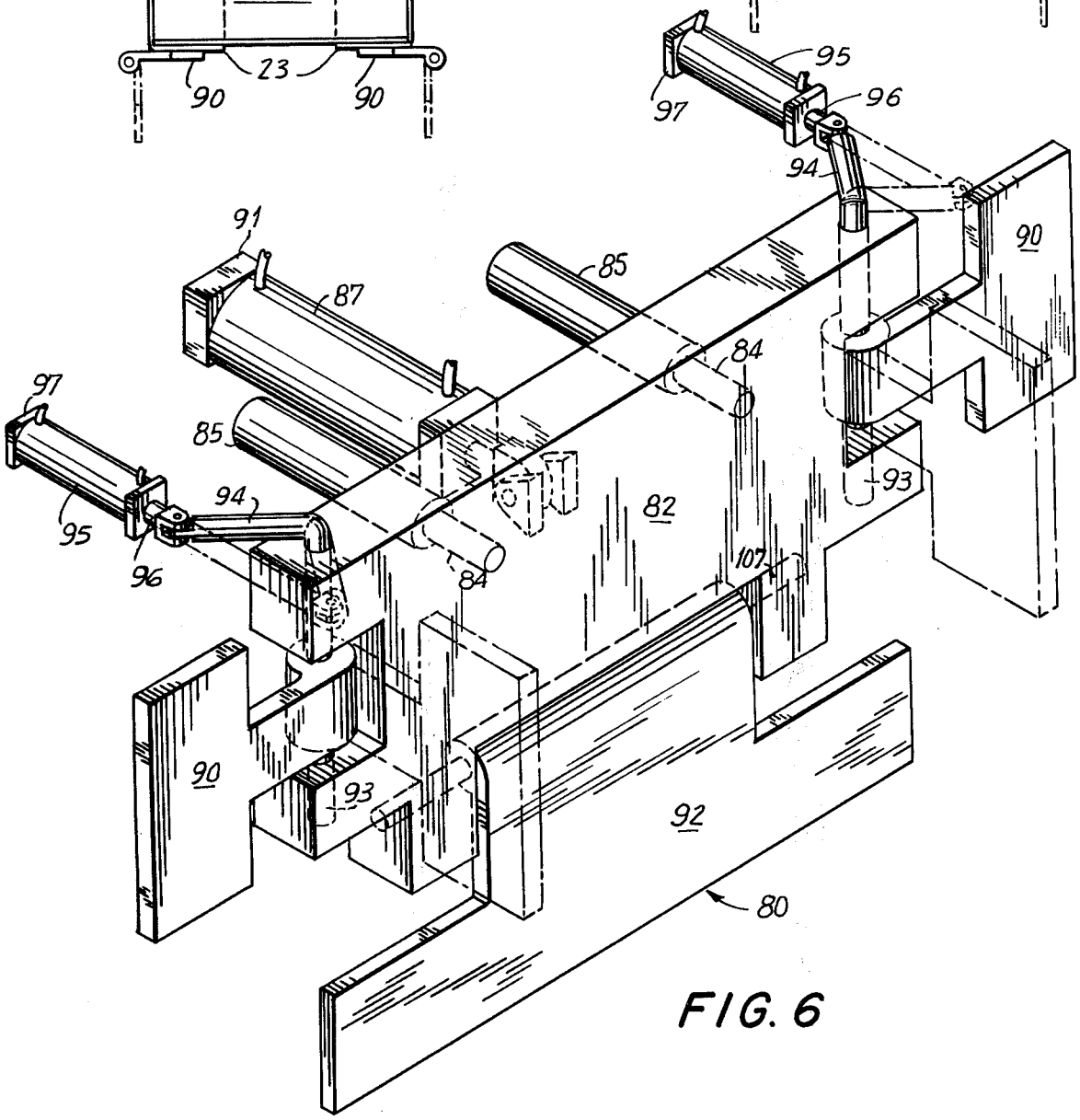
FIG. 6

APPARATUS FOR ASSEMBLING A CARTON

BACKGROUND OF THE INVENTION

The prior art relating to box-forming machines discloses a number of apparatus arrangements whereby paperboard blanks may be formed into a carton. In general, all such machines can be divided into two categories, namely, machines which form a carton from a single blank and machines which form a carton from a plurality of blanks.

Illustrative of machines of the former type are the machines disclosed in U.S. Pat. Nos. 1,548,231, 2,708,862, 2,937,578, 3,185,046 and 3,105,334. Typically, the machines disclosed in these patents form a container or carton from a single blank by manipulating the blank through the use of folding arms or moving the blank through varying arrangements of fixed machine elements whereby parts of the blank are folded and appropriately arranged to form a carton.

Most of the machines falling into the second category mentioned above appear to form so-called Bliss boxes, i.e., boxes formed from three blanks wherein there is a central blank having joining flaps which are adhesively connected to rectangular blanks that form the end walls of the box. Illustrative are the machines disclosed in U.S. Pat. Nos. 523,295, 365,879, 655,434, 3,465,652, 3,650,183, 3,659,505 and 3,673,928.

Although Bliss style boxes have been satisfactory for a number of applications, certain problems have arisen when such boxes have been used to package produce. For example, to conserve space filled cartons are generally arranged in face abutting stacks. As a result, if produce is packaged in a Bliss style box, the produce receives little or not ventilation. To overcome this problem, cartons have been designed which insure that adequate ventilation is provided substantially irrespective of the manner in which the cartons are stacked. An example of such a carton is the carton disclosed in U.S. Pat. No. 3,863,831 and shown generally in FIG. 10 of the annexed drawings. Referring to FIG. 10, it will be seen that the carton 12 is comprised of a body forming blank 14 and a pair of end forming blanks 16. The body forming blank 14 is scored so as to define a bottom panel 18 and side panels 20. Preferably, the body forming blank 14 also includes top flaps 22. Each of the end forming blanks 16 is scored so as to define an end panel 21, side flaps 23 and a bottom flap 25. As shown in FIG. 10, the side panels 20 include ventilation holes 27. As pointed out in U.S. Pat. No. 3,863,831, the side flaps 23, because of their disposition, provide an annular space when containers are stacked adjacent to each other and this provision of an annular space cooperates with the ventilation holes 27 to insure adequate ventilation.

The invention disclosed herein relates to a method and apparatus for automatically assembling a carton of the type shown in FIG. 10 from a body forming blank and a pair of end forming blanks.

SUMMARY OF THE INVENTION

A method and apparatus for assembling a carton from a body forming blank and a pair of end forming blanks wherein the body forming blank is scored to define a bottom panel and side panels and each of the end forming blanks is scored to define a pair of side flaps and a bottom flap. In accordance with this invention, the bottom forming blank is initially bent into a U-shaped configuration and a pair of end forming blanks are positioned adjacent to the open sides of the U-shaped bottom forming blank. Thereafter, the side flaps and the bottom flaps of the respective end forming blanks are folded so as to be positioned adjacent to the respective sides and bottom of the body forming blank.

Preferably, an adhesive is deposited in a longitudinal pattern, on the under surface of the body forming blank, prior to bending the body forming blank into a U-shaped configuration. Also, the end forming blanks are preferably urged against the edges of the U-shaped body forming blank prior to folding the side flaps and the bottom flaps. To accomplish this, the body forming blank is preferably bent by being pushed downwardly by the action of a mandrel and, subsequently, movable plates are employed to clamp the end forming blanks against the mandrel and the edges of the U-shaped body forming blank.

DESCRIPTION OF THE DRAWINGS

FIGS. 5, 7 and 8 are fragmentary views illustrating certain folding operations performed by the machine shown in FIGS. 1–3.

FIG. 6 is a perspective view of a sub-assembly of the machine shown in FIGS. 1–3.

DESCRIPTION OF PREFERRED EMBODIMENT

Figure 1:
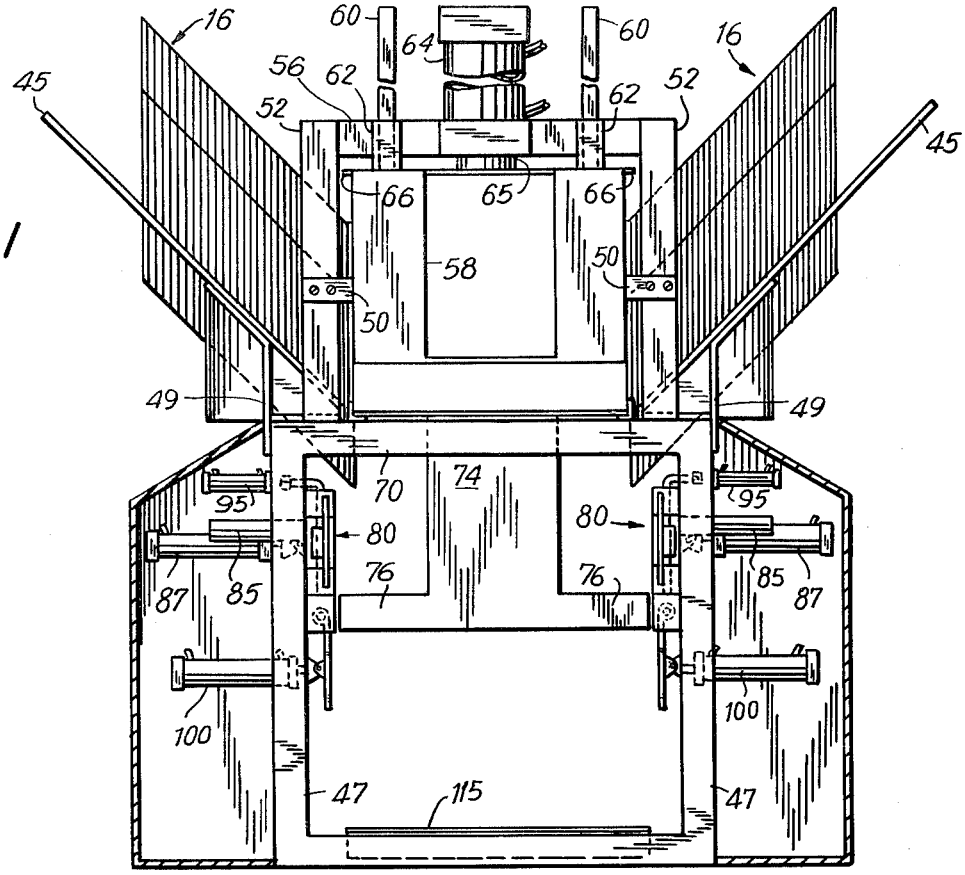
FIG. 1 is a front view of an apparatus embodying this invention.
Figure 2:
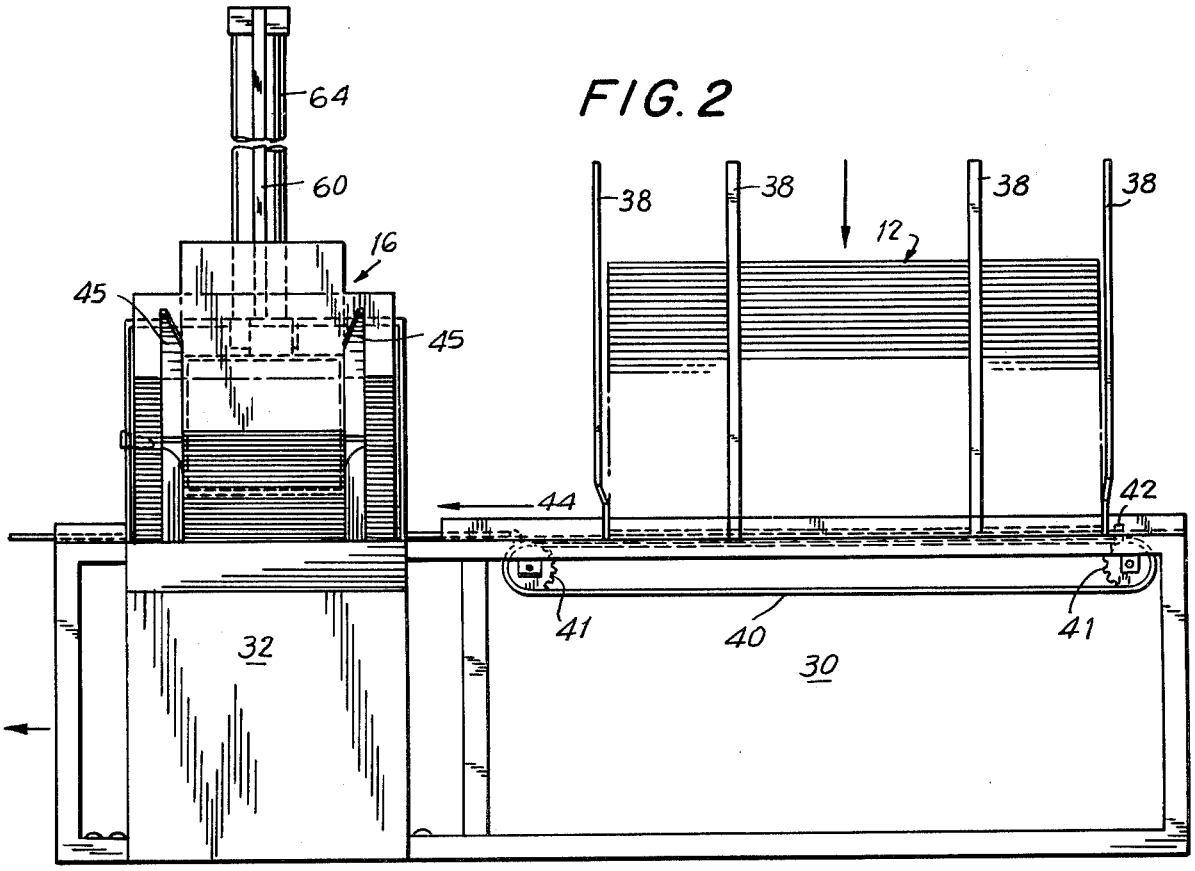
FIG. 2 is a side view of the machine shown in FIG. 1.
Figure 3:
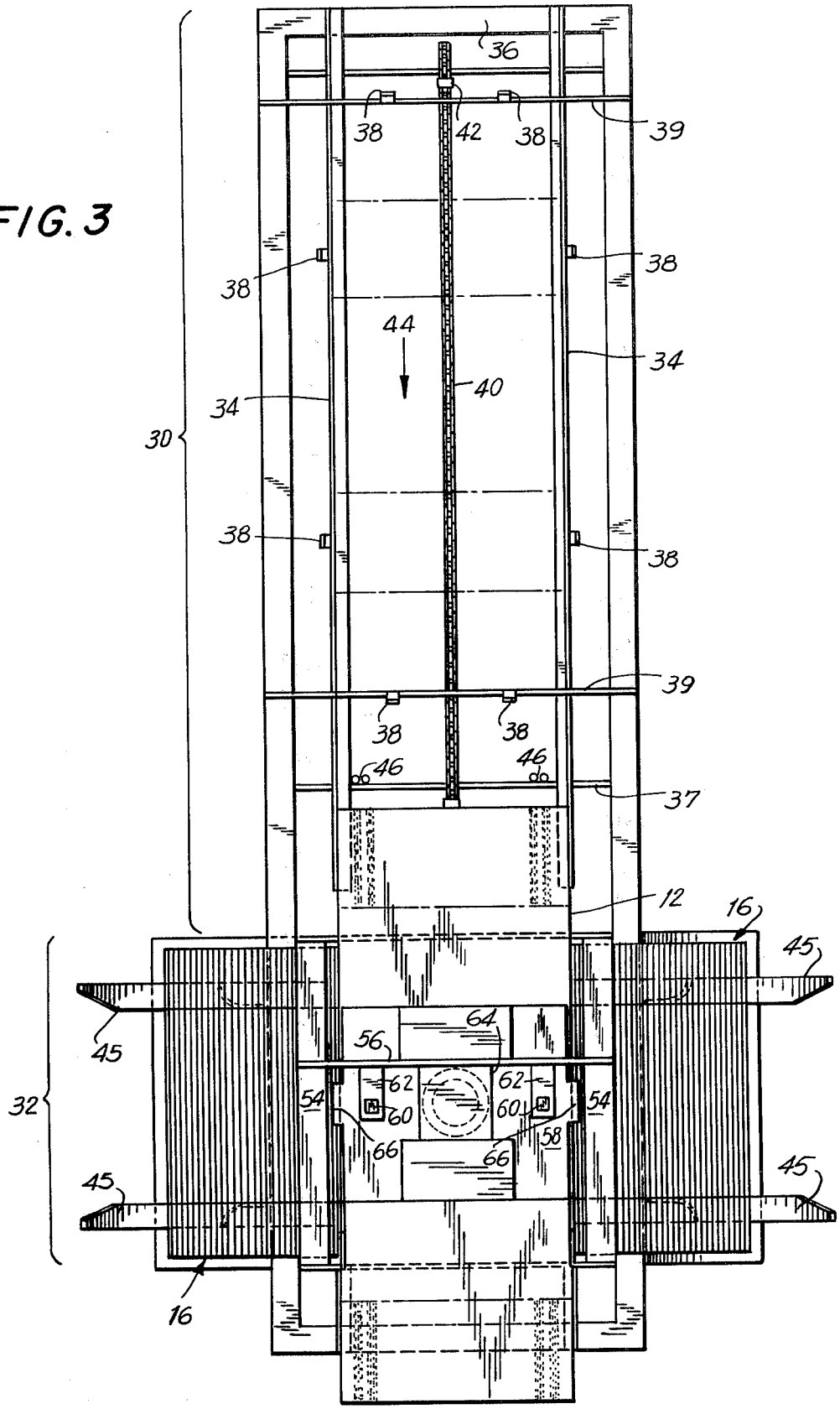
FIG. 3 is a top view of the machine shown in FIG. 2.

The machine shown in FIGS. 1–3 is comprised of a body forming blank storage station 30 and a carton forming station 32. The body forming blank storage station 30 is comprised of a pair of longitudinally disposed, L-shaped members 34 which are secured to supporting frame members such as the transverse frame members 36, 37. Upwardly extending stacking guides 38 may be provided and secured to either the L-shaped members 34 or transverse support members 39. A chain 40 is disposed longitudinally and trained over appropriate sprockets 41. A shoe 42 is fixedly secured to the chain. In this manner, when a motor (not shown) drives the chain, the shoe 42 will engage the trailing edge of the bottommost blank stored in the body forming blank storage section 30 and will feed it to the carton forming station 32 as indicated by the arrow 44. When a body forming blank is fed, it will pass over upwardly directed glue guns 46 which deposit a longitudinally disposed adhesive pattern on the under surface of the side panels and the bottom panel 18 of the body forming blank. The glue guns 46 may be actuated by means known to those skilled in the art, for example lever operated micro-switches or photocells.

Referring to FIGS. 1, 2 and 3, it wil be seen that there is located at the carton forming station 32 means for storing end forming blanks. More specifically, there are provided two pairs of outwardly and upwardly extending rails 45, each pair being secured to a respective longitudinal side of the machine. Each pair of rails 45 supports a quantity of vertically disposed end forming blanks 16. The rails 45 are each connected to the frame 47 of the machine by support members 49. Also, the innermost blank 16 is retained in position by retaining arms 50.

The retaining arms 50 are secured to upwardly extending frame members 52. As seen in FIG. 3, the frame members 52 support longitudinal frame members 54. Secured to the frame members 54 is a transverse member 56 on which a mandrel 58 is slidably mounted. More specifically, a pair of guide shafts 60 are secured to and extend upwardly from the mandrel 58 and are slidably received in bearings 62 which are secured to the transverse member 56. To reciprocably actuate the mandrel 58, there is provided a double acting cylinder 64 which is also secured to the transverse member 56 and includes a downwardly extending piston 65 which is fixedly secured to the top of the mandrel 58. Extending outwardly from the longitudinal size of the mandrel 58 are shoulders 66.

Figure 4:
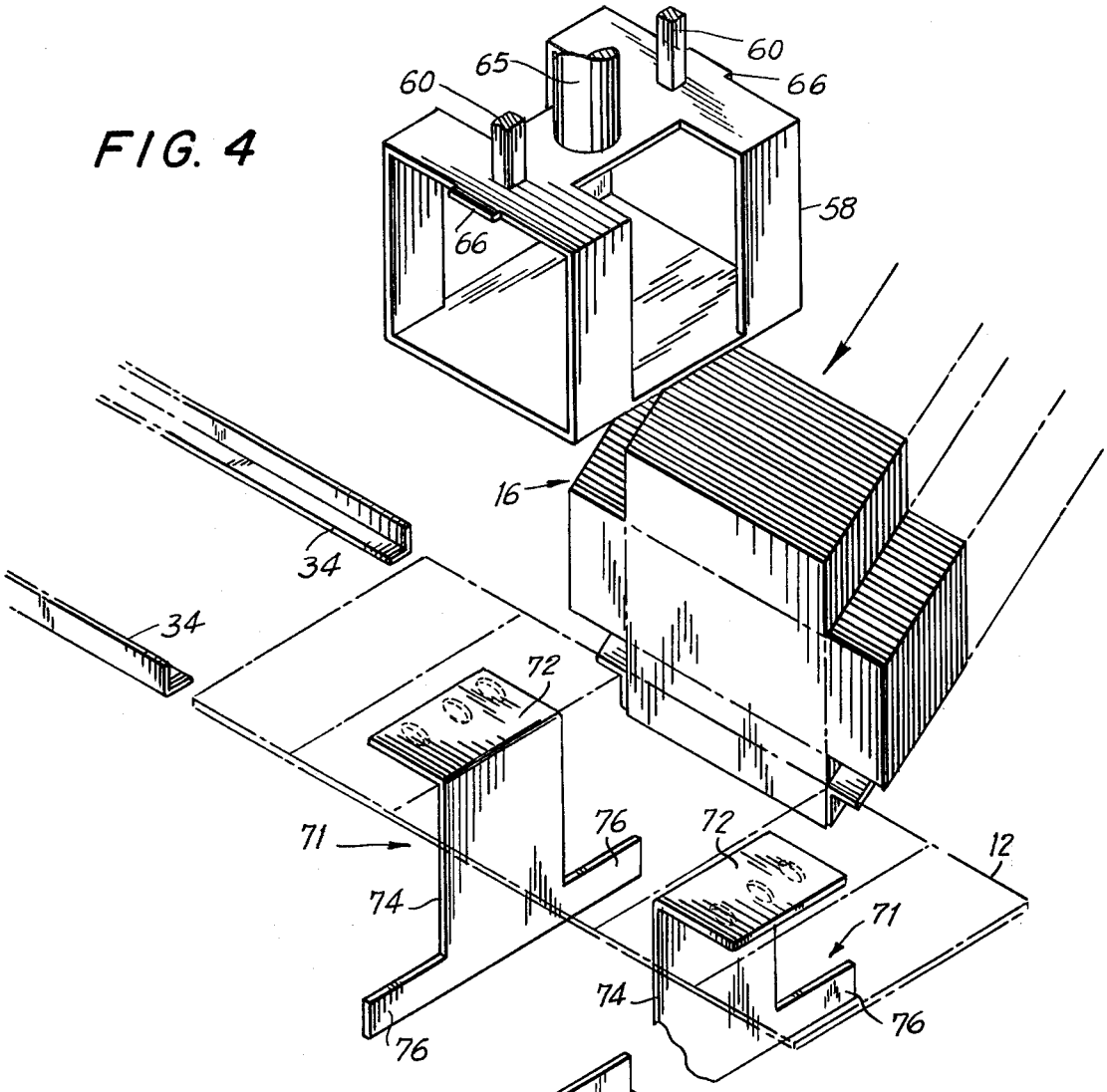
FIG. 4 is a perspective view of selected parts of the machine shown in FIG. 3.

Secured to the transverse members 70 are a pair of l-shaped plates 71 which may be seen most clearly in FIG. 4. Each of the plates 71 has an upper horizontal surface 72 and curves into a downwardly extending surface 74. The surfaces 74 extend downwardly and terminate in outwardly extending arms 76.

Figure 9:
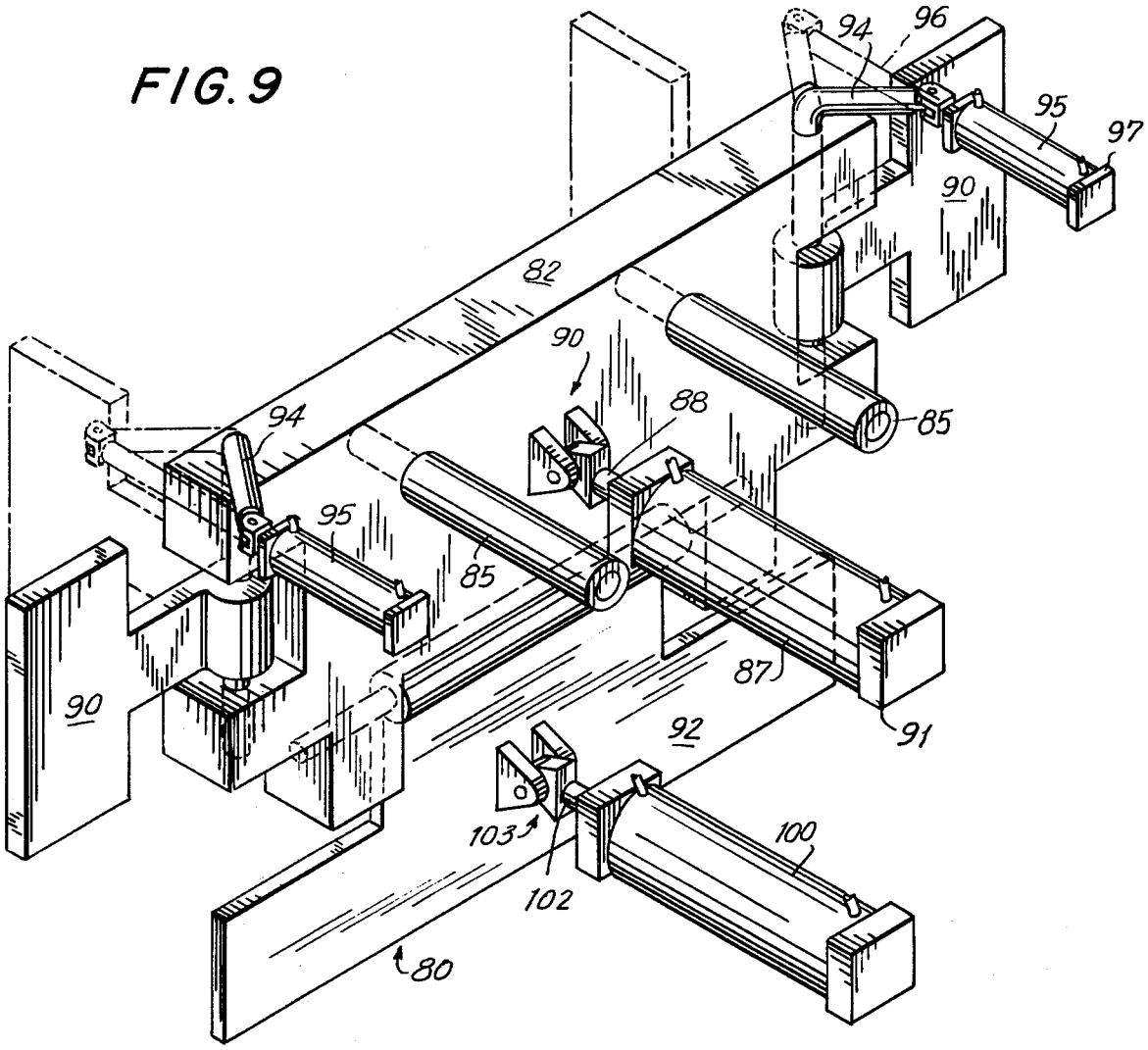
FIG. 9 is another perspective view of the sub-assembly shown in FIG. 6.

Referring again to FIG. 1, below each of the storage areas for the end forming blanks 16 there is provided side flap and bottom flap folding means 80. Referring to FIGS. 2, 6 and 9, it will be seen that each of the side flap and bottom flap folding means is comprised of an end panel positioning plate 82 having folding arms movably associated therewith. A pair of guide shafts 84 are secured to the surface of the plate 82 and are slidably received in bushings 85 which are secured to the vertical frame members 47. A double acting cylinder 87 is provided and includes a piston 88 which is pinned to the plate 82 as at 90. The rear surface 91 of the cylinder 87 is appropriately secured to the frame of the machine.

At the opposite sides of each of the plates 82 there is provided side flap folding arms 90. The side flap folding arms 90 are rotatably mounted on plate 82 by pins 93 which at their upper end, terminate in cranks 94. Associated with each of cranks 94 is a double acting cylinder 95 having a piston 96 which is pinned to the end of the crank 94. The remote end 97 of each of the cylinders 95 is appropriately secured to the frame of the machine. Thus, when the pistons 96 are in their retracted positions as shown in FIGS. 6 and 9, the side flap folding arms 90 are substantially parallel to the face of the plate 82. When the cylinders 95 are actuated so as to position the pistons 96 in their extended position, the side flap folding arms 90 are rotated 90° as shown in phantom in FIGS. 6 and 9.

As best seen in FIG. 9, a double acting cylinder 100 is provided and includes a piston 102 which is pinned to the outer face of the bottom folding arm 92 as shown at 103. The cylinder 100 is appropriately secured to the frame of the machine. When the piston 102 is in its retracted position as shown in FIG. 9, the bottom flap folding arm 92 resides in a plane substantially aligned with the face of the plate 82. Referring to FIG. 6, it will be seen that the bottom flap folding arm 92 is rotatably mounted on the plate 82 by pin 107. Thus, when the cylinder 100 is actuated such that the piston 102 is in its extended position, the bottom flap folding arm 92 is rotated 90° and the bottom flap folding arm assumes a position perpendicular to the plate 82.

Figure 5:
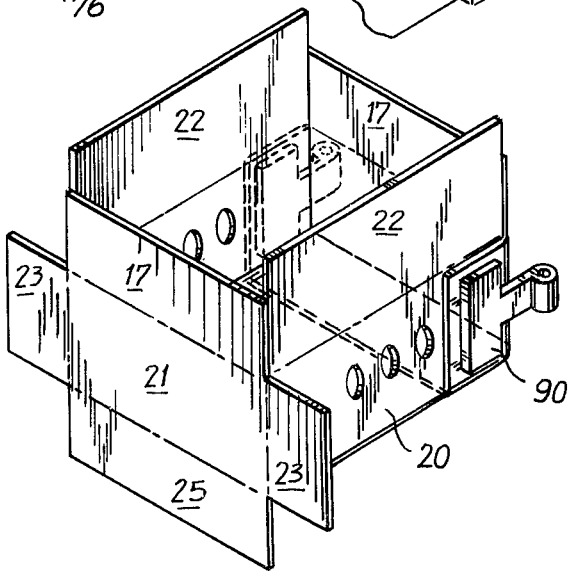

Having described the component parts of the machine shown in the drawings, the operation of the machine may now be set forth. Initially a body forming blank is fed from the body forming blank storage station 30 by action of the chain 40 and the shoe 42. During the feeding operation, the blank passes over the upwardly directed glue guns 46 and a longitudinal pattern of hot melt adhesive is deposited on the undersurface of the bottom panel and the side panels of the body forming blank. At the end of the longitudinal travel of the shoe 40, the body forming blank is positioned within the carton forming station 32 of the machine. More specifically, as best seen in FIG. 4, the body forming blank 12 shown in phantom in FIG. 4 is positioned such that the bottom panel 18 is in registry over the cavity defined by the downwardly extending plates 74. At this point, the mandrel 58 is in its retracted position. Once the blank 12 has been appropriately positioned, the cylinder 64 is actuated driving the mandrel 58 downwardly. During its downward travel, the shoulders 66 engage the upper surface of the two end forming blanks 16 which are closest to the mandrel and drive these end forming blanks downwardly. Upon continued downward movement of the mandrel, the mandrel pushes the body forming blank 22 downwardly through the cavity defined by the plates 74 whereby the body forming blank is bent into a U-shaped configuration. The mandrel 58 continues its downward movement until the side flaps 23 on each of the end forming blanks are resting on the upper surface of the arms 76. At that point, there is a dwell in the movement of the mandrel 58. During this dwell, the cylinders 87 are actuated thereby transversely driving the end panel positioning plates 82 inwardly. Thereby, the end panels 21 are pressed against the edges of the mandrel 58. When the end panels are thus positioned, the cylinders 95 and 100 are actuated whereby the side flap folding arms 90 and the bottom flap folding arms 92 are rotated 90° thereby folding the side flaps 23 and the bottom flaps 25 against the side and bottom of the U-shaped body forming blank, as shown in FIGS. 5, 7 and 8. In this regard, it will be remembered that a longitudinal pattern of adhesive has been previously been deposited upon the under surface of the body forming blank and, thus, when the side flaps and the bottom flaps are folded 90°, the side flap folding arms and the bottom flap folding arms press the side flaps and the bottom flaps against the corresponding, adhesively coated portions of the body forming blank. At this point, there is a brief dwell while the side flaps and the bottom flaps are pressed and held in position, i.e., there is a dwell period sufficient to allow the previously deposited hot melt adhesive to set. Also, at this point it is appropriate to note that the mandrel 58 is within the now formed box and thus provides a backing surface against which the various folding arms may press.

Figure 10:
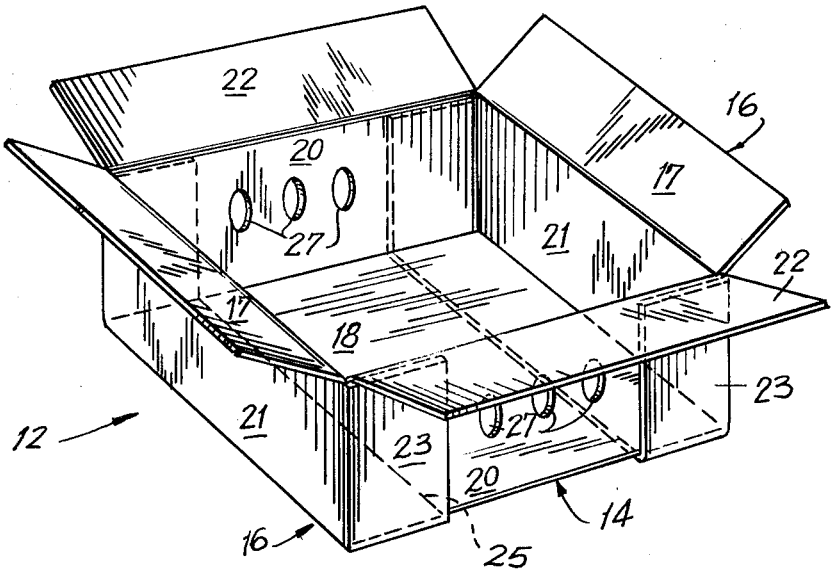
FIG. 10 is a perspective view of a carton formed by the practice of the method and apparatus comprising this invention.

After a dwell period of a length appropriate to allow setting of the adhesive, the side flap folding arms and the bottom flap folding arms are retracted by reverse actuating cylinders 95 and 100 respectively. Thereupon, the cylinder 87 is reverse actuated thus retracting the end panel positioning plates 82. Thereafter, the cylinder 64 is reverse actuated thus retracting the mandrel 58. Conventional stripper devices may be employed to insure that the formed box is stripped off the mandrel when it is retracted. Upon such stripping action, the formed box may drop downwardly through the machine and be deposited upon a conveyor belt 115 shown in FIG. 1. Thus, there exits from the machine a formed box of the type shown in FIG. 10.

Returning again to a consideration of FIG. 1, several design features of the machine may be noted. Thus, it will be clear from the relative dimensions of the mandrel and the center portion of the end forming blanks that when the mandrel is in its extended position, the shoulders 66 are not positioned below the lowermost edge of the next pair of end forming blanks. Thus, upon retraction of the mandrel, the shoulders 66 may simply slide along the interior surface of the next pair of end forming blanks. Also, it will be appreciated that the width of the plates 74 as shown in FIG. 1 should be less the distance between the adhesive patterns deposited on the body forming blank to insure that the adhesive is not wiped off when the body forming blank is bent into a U-shaped configuration.

Also, the width of the mandrel is preferably equal to the width of the bottom panel. When this condition is satisfied, the plates 82 will then press the end forming blanks against the longitudinal faces of the mandrel and also against the edges of the body forming blank along the open portion thereof. To insure that this action results, the plates 82 preferably reciprocate between a first position and a second position wherein, in the first position, the plates are spaced apart from the mandrel and, in the second position, the plates 82 position the end forming blanks against the exposed edges of the body forming blank.

With respect to the control of the components hereinbefore described, it has been found that a conventional arrangement of ganged, motor-driven, cam-operated micro-switches provide satisfactory control. The arrangement and interconnection of such micro-switch control will be clear to those skilled in the art to which this invention pertains and thus a detailed description thereof has not been set forth.

Although a preferred form of my invention has hereinbefore been described, it is anticipated that others may perceive modifications thereof without deviating from the scope of my invention as set forth in the claims depended hereto.

I claim:

1. A machine for forming a carton from a body forming blank which is scored to define a bottom panel and side panels, and a pair of end forming blanks each of which is scored to define an end panel, said flaps and a bottom flap, said machine comprising:

a. a frame;

b. means mounted on said frame defining a carton forming cavity which includes side panel folding means;

c. a mandrel reciprocably mounted on said frame for movement into and out of said carton forming cavity;

d. means mounted adjacent the sides of said carton forming cavity of storing end forming blanks;

e. means for feeding a pair of end forming blanks into said carton forming cavity;

f. means for positioning a body forming blank over said carton forming cavity; and g. two pairs of side flap folding arms and a pair of bottom flap folding arms for folding said side flaps and said bottom flaps against a body forming blank when said mandrel is at the end of its downward movement.

2. The apparatus of claim 1 wherein said folding arms are mounted on transversely movable plates.

3. The apparatus of claim 1 which further comprises:

a. a pair of parallel, spaced apart plates, movably mounted on said frame adjacent to the bottom of said carton forming cavity;

b. means for positioning said plates in either a first position wherein said plates are spaced apart a distance greater than the width of said bottom panel or a second position wherein said plates are spaced apart a distance substantially equal to the width of said bottom panel;

c. two pairs of side flap folding arms, a respective pair of each of said side flap folding arms being movably mounted on a respective one of said plates; and d. means for moving said flap folding arms.

* * * * *